United States Patent [19]

Goettel et al.

[11] 4,308,222

[45] Dec. 29, 1981

[54] EVAPORATIVE COOLER

[76] Inventors: Richard J. Goettel, 7824 N. 36th Dr.; Franklyn F. Kelley, 7802 N. 36th Dr., both of Phoenix, Ariz. 85021

[21] Appl. No.: 166,030

[22] Filed: Jul. 7, 1980

[51] Int. Cl.[3] ..... F28D 5/80

[52] U.S. Cl. ..... 261/117; 62/314; 159/4 F; 55/440; 55/257 PV

[58] Field of Search ..... 62/314, 309, 310, 304; 159/4 F; 55/257 PV, 440, 90; 261/117, 115, 118

[56] References Cited

U.S. PATENT DOCUMENTS

| | | | |
|---|---|---|---|
| 1,936,243 | 11/1933 | Anderson | 261/117 |
| 2,090,287 | 8/1937 | Cornelius | 55/257 PV |
| 2,114,787 | 4/1938 | Smith | 159/4 K |
| 2,554,428 | 5/1951 | Swearingen | 159/4 F |
| 2,774,660 | 12/1956 | Cook et al. | 159/4 F |
| 3,795,089 | 3/1974 | Reither | 261/117 |

*Primary Examiner*—Norman Yudkoff

*Attorney, Agent, or Firm*—Herbert E. Haynes, Jr.

[57] ABSTRACT

An apparatus for evaporatively cooling air including an air moving mechanism for supplying air under pressure to an evaporator duct wherein water is sprayed into the airstream countercurrent to the airflow direction. The evaporator duct is especially configured to inhibit moisture migration toward the air moving device and the sprayed water is precooled to increase operating efficiency. A second stage of evaporative cooling may be included by tandemly coupling a second stage evaporator duct to the outlet of the first stage evaporator duct.

17 Claims, 3 Drawing Figures

EVAPORATIVE COOLER

BACKGROUND OF THE INVENTION

1. Field of the Invention

This invention relates in general to air conditioning devices and more particularly to an air conditioning apparatus which operates on the principal of evaporative cooling.

2. Description of the Prior Art

Devices for cooling air by the evaporation principal have been used for many years with the most successful use of such devices being in relatively dry climates for both commercial and residential applications.

The most common evaporative cooler in use today includes a cabinet in which an air moving device, usually in the form of a motor driven centrifugal blower, is mounted for drawing ambient air into the cabinet through wettable pads mounted in the sides thereof. As the relatively dry ambient air moves through the wet pads, it is cooled by evaporation and the air moving device delivers the cooled air to an outlet that is normally located in the bottom of the cabinet. A sump located in the bottom of the cooler cabinet is provided with a float valve which maintains a predetermined water level in the sump, and a motor driven pump is employed to supply water under pressure from the sump into a distribution plumbing network mounted in the top of the cabinet. The water is delivered to the tops of the pads by the plumbing network and flows under the influence of gravity through the pads with the unevaporated water returning to the sump for recirculation.

Although evaporative coolers of the above described type are recognized as low cost and relatively efficient devices, there are several problems associated with the use, operation, maintenance, and deterioration of such devices.

The wettable pads mounted in the sides of the cooler cabinet provide resistance to the inflow of ambient air into the cabinet. A certain amount of this resistance is taken into consideration by designing the cooler with an air moving device of a larger size than would be needed in the absence of this resistance. The oversized air moving device is higher in initial and operating costs, however, the real problem is encountered by contamination buildup in the pads. Since evaporation occurs within and proximate the pads, calcification or mineral deposition, along with airborne dirt and other foreign matter will collect in the pads thus increasing the resistance to airflow therethrough. The pads commonly used are loosely packed excelsior wrapped in a relatively large mesh fabric such as cheesecloth. It is not practical to clean such pads thus, periodic replacement is required. In view of this, it will be seen that the operating efficiency and operating costs will steadily become worse as the cooler is used, and will become a serious problem if the period between pad replacement is excessively long, or if replacement is ignored entirely as is all too often the case.

Other problems with the wettable pads used in the prior art evaporative coolers include channelization of the water trickling through the pads, improperly packed excelsior which results in dry spots and uneven airflow through the pads, and the pads are a fire hazard when they are dry.

The moisture laden air emerging from the cooler pads into the interior of the cabinet will deposit some of the entrained moisture on every surface and operating component in the cabinet. For this reason, the interior cabinet surfaces, motor mounts, air moving structure, and the like within the cabinet are galvanized or otherwise provided with rustproofing coatings to minimize the corrosive effect of the moisture. The most serious problem resulting from this moisture entrainment is that it is deposited on the electric wiring, connections, and on the motors which operate the air moving device and the pump, and actually enters into the motors themselves through the air circulation ports thereof and is deposited on the motor windings. Such mineral deposition on the electric components causes a general deterioration of the wiring and the motors and in time, which can be quite short in areas of highly mineralized water, will cause shorting out of the motors. This general deterioration of the electric components coupled with the above mentioned highly flammable state of cooler pads when they are dry results in a serious fire hazard and due to the close proximity of water and wet components when the coolers are operating, a high electric shock potential is present.

Another problem with these prior art evaporative coolers is the relatively high occurrence rate of flooding damage brought on by the float controlled water inlet valves which malfunction due to contaminants in the water and cause the sumps to overflow.

Another type of evaporative cooler was suggested in U.S. Pat. No. 1,951,962 issued to F. G. Baum on Mar. 20, 1934. In this evaporative cooler, a motor is axially mounted in a duct casing with the motor having an output shaft which extends from opposite ends thereof. A first fan driven by the motor is located at the outlet of the casing and is operated to draw air through the casing and thereby create a zone of reduced air pressure therein. A second fan on the other end of the motor has an enlarged hub with tubes extending radially therefrom and having spray nozzles on the ends of those tubes. A third fan is gear driven off of the hub of the second fan and includes a revolving dipper mechanism for supplying water from a sump to the radial tubes of the second fan. The three fans induce a swirling airflow through the casing and the rotating tubes centrifugally deliver water to the spray nozzles which spray that water into the air movement path through the duct casing. This cooler did not achieve any appreciable degree of commercial success to the best of our knowledge due to its costs, complexity, and due to all of its operating components being located within the duct casing where they are subject to corrosion and mineral deposition.

Other devices have been devised in which the cooling of air by evaporation inherently occurs as a result of the principal objectives of those devices. Those devices, which are exemplified in U.S. Pat. Nos. 2,709,578 and 3,406,498, have the primary objectives of humidification and the washing of air or gas, and all have the same basic problems of costs, complexity and component damage due to corrosion and mineral deposition, and relatively high electric shock and fire hazard potential.

Therefore, a need exists for a new and improved evaporative cooler which overcomes some of the problems and shortcomings of the prior art.

SUMMARY OF THE INVENTION

In accordance with the present invention, a new and improved evaporative cooler apparatus is disclosed which eliminates the need for the traditional cooler pads, and in so doing provides a free, unrestricted inflow of ambient air into the cooler, and eliminates the other problems associated with those pads. The cooler is configured so that the interior thereof is entirely free of any electrical components or wiring thus, eliminating the prior art problems of mineral deposition causing motor burnout and substantially reducing the high fire hazard and electric shock potential of the prior art coolers. Minimum structural elements are used in the interior of the cooler which in conjunction with an inherent washing and flushing action which occurs at all times when the cooler is operating, minimizes corrosion and mineral deposition within the cooler.

The evaporative cooler of the present invention includes a motor driven air moving device the air inlets of which are open to ambient and having its air outlet connected to the air inlet of an especially configured evaporator duct.

The air inlet of the evaporator duct slopes angularly downwardly and opens into one end of a main, or expansion chamber the opposite end of which forms an air outlet. The angular disposition of the air inlet reduces the occurrence of moisture migration toward the air moving device. Water under pressure from a suitable source is regulated and supplied to a spray nozzle located in the expansion chamber so that finely divided water is sprayed toward the air inlet countercurrent to the incoming airflow path. The water is evaporated and cooled moisture laden air moves through a free moisture extractor or separator, located in the expansion chamber downstream of the spray nozzle.

The unevaporated water falls under the influence of gravity into a collection sump located in the bottom of the expansion chamber, and the water collected in the sump is maintained at a predetermined level therein by an overflow which carries foreign material away with the overflowing water. The water in the sump is used for precooling of the water which is supplied to the spray nozzle to increase the heat absorbing capability of that incoming water.

The evaporatively cooled air emerging from the air outlet of the evaporator duct may be supplied directly to a point of use. Alternately, a second stage of evaporative cooling may be provided by coupling a second stage evaporator duct in tandem with the first stage evaporator duct and spraying a finely divided water mist countercurrent to the air movement through the second stage evaporator duct.

Accordingly, it is an object of the present invention to provide a new and improved device for cooling air by the evaporation principle.

Another object of the present invention is to provide a new and improved evaporative cooler apparatus the air inlets of which are open to ambient to provide a free unrestricted flow of air into the cooler.

Another object of the present invention is to provide a new and improved evaporative cooler which is especially configured to reduce the damaging effects resulting from corrosion and mineral deposition.

Another object of the present invention is to provide a new and improved evaporative cooler having its air moving drive motor located exteriorly of the cooler and having a substantially unobstructed interior to reduce the occurrence of corrosion and mineral deposition damage.

Another object of the present invention is to provide a new and improved evaporative cooler apparatus having an air moving device which supplies air to an evaporator duct in which finely divided water is sprayed countercurrent to the incoming air for cooling thereof by evaporation.

Another object of the present invention is to provide a new and improved evaporative cooler of the above described type having a free moisture collection sump which is employed for precooling of the incoming water.

Still another object of the present invention is to provide a new and improved evaporative cooler of the above described character wherein the evaporator duct includes an air inlet which slopes angularly downwardly into an expansion chamber to reduce the occurrence of moisture migration toward the air moving device.

Still another object of the present invention is to provide a new and improved evaporative cooler of the above described character wherein the expansion chamber of the evaporator duct is of larger cross section than the air inlet to reduce air velocity during the evaporation process.

Yet another object of the present invention is to provide a new and improved evaporative cooler of the above described character wherein a second stage evaporative cooling structure may be provided by coupling the air inlet of a second stage evaporator duct to the air outlet of the first stage evaporator duct.

The foregoing and other objects of the present invention, as well as the invention itself, may be more fully understood from the following description when read in conjunction with the accompanying drawings.

DESCRIPTION OF THE PREFERRED EMBODIMENTS

Figures 1, 2, 3:
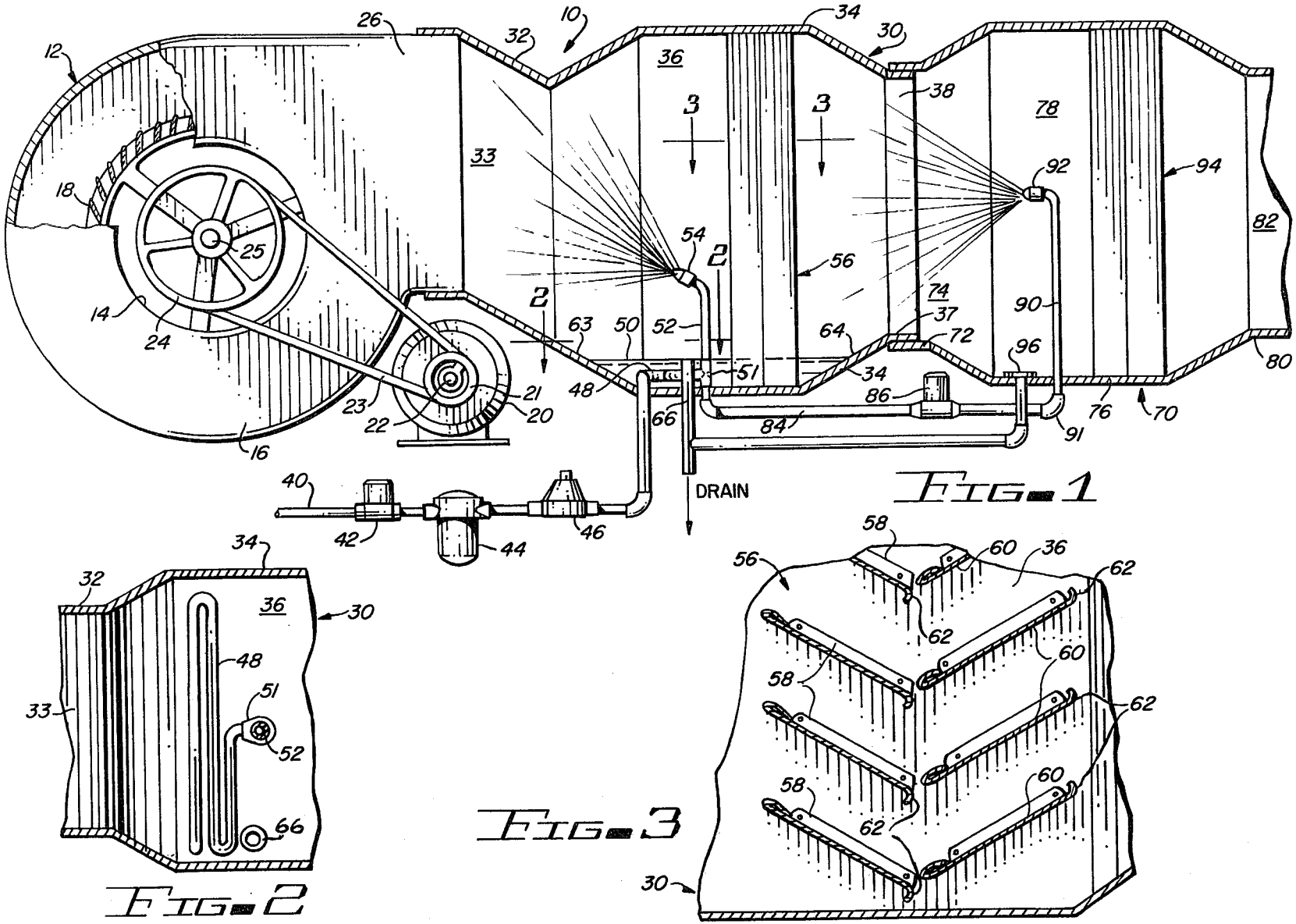
FIG. 1 is a sectional view taken longitudinally of the evaporative cooler of the present invention and illustrating the various features thereof.
FIG. 2 is a sectional view taken along the line 2—2 of FIG. 1.
FIG. 3 is a sectional view taken on the line 3—3 of FIG. 1.

Referring more particularly to the drawings, FIG. 1 illustrates the improved evaporative cooler of the present invention which is indicated in its entirety by the reference numeral 10.

The evaporative cooler apparatus 10 includes an air moving means in the preferred form of a motor driven centrifugal blower 12. The centrifugal blower 12 is of well known configuration having a pair of axial air inlets 14 (one shown) formed in the opposite sidewalls of the housing 16. A blower wheel 18 is journaled for rotation within the housing 16 and is driven by an electric motor 20 having a pulley 21 on its output shaft 22. A suitable drive belt 23 connects the motor's pulley 21 with a pulley 24 which is mounted on the axle 25 of the blower wheel. Rotation of the blower wheel 18 creates a negative static pressure within the housing 16 which draws ambient air into the housing through the axial air inlets 14, and that air is expelled under pressure through the centrifugal air outlet 26.

An evaporator duct, which is indicated generally by the reference numeral 30, is connected to receive the air under pressure from the air moving means 12, and the evaporator duct is of special configuration as will now be described in detail.

The evaporator duct 30 is provided with an air inlet duct section 32 which is suitably connected to the air outlet 26 of the air moving means 12, and is configured to define an air inlet passage 33. The air inlet duct section 32 slopes angularly and downwardly and is integral with a main, and preferably enlarged, duct section 34 which defines an expansion chamber 36 internally thereof, and the opposite end of the main duct section 34 is necked down to form an air outlet section 37 which defines an air outlet port 38.

A water supply line 40 is connected to receive water under pressure from a suitable source such as a municipal water supply. The water supply line 40 has a shutoff valve means 42 located therein, which may be a simple manually operable gate valve, but is preferably in the form of a solenoid valve due to the remotely controllable characteristics of such a device. A filter 44 may be provided in the water supply line 40 for removing particulate matter from the water for reasons which will become apparent as this description progresses. An adjustable pressure regulator 46 is provided in the water supply line 40 for adjustably regulating the pressure of the water delivered to the evaporative cooler 10.

The water supply line 40 passes through the wall of the enlarged duct section 34 of the evaporator duct 30 and is arranged in a serpentine configuration as shown in FIG. 2, which forms a coil 48 that is disposed adjacent the bottom of the expansion chamber 36, with the bottom of the expansion chamber serving as a water collection sump 50 as will hereinafter be described.

The coil 48 of the water supply line 40 is suitably connected as at 51, to an upstanding pipe 52 which is bent adjacent its uppermost end so that this end is in alignment with the air flow axis through the air inlet passage 33 of the evaporator duct 30. A suitable spray nozzle 54 is mounted on the bent end of the upstanding pipe 52 so that water supplied under pressure from the supply line 40 is sprayed in a finely divided mist from the nozzle in a direction which extends angularly upwardly from the nozzle countercurrent to the air movement through the air inlet duct section 32. In this manner, evaporation, and thus cooling of the incoming air, will commence within the air inlet duct section 32, and due to the angular attitude of the air inlet duct section, the migration of moisture toward the air moving means 12 is inhibited.

As the incoming air moves from the inlet duct section 32 into the expansion chamber 36, the increased cross section of that chamber results in a reduction of the velocity of the air. The reduction of air velocity within the expansion chamber 36 provides an increase in the throughput time of the moving air to allow the evaporation process to be completed within the relatively short length of the evaporator duct 30, and also facilitates dropout and removal of free moisture carried by the moving air.

An extractor means 56 is located in the expansion chamber 36 downstream of the spray nozzle 54 for removing free moisture from the moving air by providing a tortuous path through which the air must move. The extractor means 56 includes a first plurality of vanes 58 which are in spaced parallel relationship with respect to each other and are disposed transversely and vertically within the expansion chamber 36 at an angle with respect to the airflow axis through the expansion chamber. A second plurality of vanes 60 are positioned immediately downstream of the first plurality of vanes 58 and are disposed in a similar manner with the exception of the angular relationship of the vanes 60 with respect to the airflow axis. The first set of vanes 58 are arranged to deflect the moving air toward one side of the evaporator duct 30 and the second set of vanes 60 are arranged to deflect the air toward the opposite side of the evaporator duct.

The moving air will easily negotiate the tortuous path through the extractor means 56 however, the free moisture carried by the moving air will impinge on the vanes 58 and 60 and gravity will cause the deposited moisture to move down the vanes toward the bottom of the expansion chamber 36 where it is collected in the sump 50.

The previously described reduction in air velocity which occurs in the expansion chamber 36 aids in the free moisture removal in that the moisture velocity is kept at a point where it will not bounce off of the extractor means 56 and reenter the moving airstream.

As shown, the trailing edges 62 of each of the vanes 58 and 60 is curved into the airstream so that the extracted moisture, which will tend to collect on the trailing edges of the vanes due to air movement, will not be carried off from those trailing edges by the moving air.

The free moisture which falls from the moving air of its own accord, that which collects on the walls of the evaporator duct 30, and that removed by the extractor means 56 all end up in the collector sump 50 which, as hereinbefore mentioned, is provided in the bottom of the expansion chamber 36. The water in the collection sump will be at, or nearly at wet bulb temperature due to evaporation and since the coil 48 is submerged in that water, the incoming water is cooled on its way to the spray nozzle 54. This precooling of the incoming water increases its heat absorbing capability and thus increases the operating efficiency of the evaporative cooler 10.

It will be noted that the bottom surface of the air inlet duct section 32 slopes towards the sump 50, and the bottom surfaces 63 and 64 of the enlarged duct section 34 convergingly slope into the sump. The angularly and downwardly sloping attitude of those surfaces facilitate gravitational flow of the free moisture into the sump 50.

The water in the sump 50 is maintained at a predetermined level by means of an overflow pipe 66 which extends from the sump exteriorly of the evaporative cooler 10 for carrying the excess water away to a suitable disposal point.

The temperature of the air entering into the evaporative cooler 10 is at the dry bulb temperature and due to the evaporative cooling which takes place in the evaporator duct 30, the air emerging from the air outlet port 38 will be lowered to a temperature which is at, or near, the average of the wet and dry bulb temperatures. This temperature drop will be sufficient for many evaporative cooler applications, however, a second stage of evaporative cooling may be added to provide a further air temperature drop.

As shown in FIG. 1, a second stage evaporator duct 70 may be mounted in tandem with the first stage evaporator duct 30. The second stage evaporator duct 70 includes an air inlet duct portion 72 which is coupled to the air outlet duct section 37 of the first stage evaporator duct 30 and defines an air inlet passage 74 therein. The air inlet duct portion 72 is integral with one end of a main, and preferably enlarged, duct section 76 which defines a second stage expansion chamber 78. The other end of the main duct section 76 is necked down to form an air outlet duct section 80 which defines an air outlet port 82. The air inlet passage 74, the expansion chamber 78 and the air outlet port 82 are all in axial alignment with each other.

A branch water line 84 is coupled to the water supply line 40 at a point downstream of the coil 48, so that precooled water under pressure is supplied to the branch line 84. The branch water line 84 has a shutoff valve means 86 mounted therein in the preferred form of a remotely controllable electric solenoid valve.

An upstanding pipe 90 is connected, as at 91, to the branch water line 84 and extends upwardly through the wall of the enlarged duct section 74 into the second stage expansion chamber 78. The upstanding pipe 90 is bent adjacent its free end so that this end lies on the longitudinal axis of the second stage evaporator duct 70 and faces the air inlet passage 74. A spray nozzle 92 is mounted on the bent-over end of the upstanding pipe 90, and in this manner, finely divided water is sprayed directly into the airstream countercurrent to the airflow direction.

An extractor means 94 is located in the second stage expansion chamber 78 for free moisture removal purposes. The extractor means 94 may be configured in the same preferred manner as the hereinbefore fully described extractor means 56, and therefore, repeating of that description is deemed as unnecessary.

The free moisture which is collected in the second stage evaporator duct 70 will migrate to the bottom of the second stage expansion chamber 78 and is carried away by a drain pipe 96 which may be connected to the overflow pipe 66 of the first stage evaporator duct 30.

The temperature of the air entering into the second stage evaporator duct 70 is at, or near, the average of the dry bulb and wet bulb temperatures as hereinbefore described. This average temperature of the incoming air is reduced, due to evaporation in the second stage evaporator duct 70, to a lower average which is approximately half way between the wet bulb temperature and the temperature of the air entering into the second stage evaporator duct 70.

Additional stages of evaporative cooling may be added to the above described evaporative cooler 10 of the present invention. However, the temperature drop achieved in successive stages becomes progressively smaller. Due to such diminishing returns, it has been found that further stages beyond the two stages of evaporative cooling disclosed herein, are not practical from an economic standpoint.

Experimentation has shown that the free moisture in the air moving through the first evaporator duct 30 must be removed prior to its passage through the second evaporator duct 70. In the absence of this free moisture removal, the second evaporator duct 70 will do little, or nothing, to the air moving therethrough.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, the function of extracting free moisture from the air moving through the evaporative cooler can be efficiently accomplished by simply bending the evaporator ducts at the appropriate locations. The air, of course, can negotiate the bend whereas the free moisture cannot. Therefore, the extractor means 56 and 94 hereinbefore described may be in the simplified form of bent ducts.

The appended claims are therefore intended to cover and embrace any modifications within the limits only of the true spirit and scope of the invention.

What we claim is:

1. An apparatus for evaporatively cooling air comprising:
   (a) an evaporator duct;
   (b) means coupled to said evaporator duct for supplying air under pressure thereto;
   (c) a spray nozzle in said evaporator duct for spraying finely divided water into the incoming air stream countercurrent to the flow direction thereof;
   (d) extractor means in said evaporator duct downstream of said spray nozzle for extracting free moisture from the air movable through said evaporator duct;
   (e) a water collection sump in said evaporator duct for receiving the free moisture from the air movable through said evaporator duct;
   (f) overflow means in said sump for disposing of water in excess of a predetermined amount; and
   (g) a water supply conduit for delivering water from a remote source of fresh water under pressure to said spray nozzle, said water supply conduit passing through said sump below the surface of the water receivable therein and in heat exchange therewith for precooling of the water deliverably by said water supply conduit to said spray nozzle.

2. An apparatus as claimed in claim 1 wherein said evaporator duct defines a substantially horizontal air movement path and includes means for receiving the air from said means for supplying air under pressure and directing the received air angularly and downwardly into the substantially horizontal air movement path.

3. An apparatus as claimed in claim 1 wherein said evaporator duct comprises:
   (a) an air inlet duct section of equal cross sectional area along its length and defining an angularly downwardly sloping air inlet passage;
   (b) a main duct section integral with said air inlet duct section for receiving the air delivered thereby, said main duct section having a substantially horizontal air movement path therethrough.

4. An apparatus as claimed in claim 3 wherein said spray nozzle is located in said main duct section and is disposed to spray the finely divided water angularly and upwardly into the air inlet passage defined by said air inlet duct section.

5. An apparatus as claimed in claim 3 wherein said main duct section is of larger cross section than said air inlet duct section and defines an expansion chamber in which the air entering said main duct section from said air inlet duct section is reduced in velocity.

6. An apparatus as claimed in claim 1 wherein said extractor means comprises:
   (a) a first plurality of spacedly arranged vertically extending vanes which are angularly disposed to deflect air movement through said evaporator duct toward one side thereof; and
   (b) a second plurality of spacedly arranged vertically extending vanes mounted immediately downstream of said first plurality of vanes and angularly disposed to deflect air movement through said evaporator duct toward the opposite side thereof.

7. An apparatus as claimed in claim 6 wherein each of the vanes of said first and second plurality of vanes are of substantially planar configuration having an elongated trailing edge which is curved into the airstream of the air deflected thereby.

8. An apparatus as claimed in claim 1 and further comprising:

(a) a second stage evaporator duct tandemly connected to said evaporator duct for receiving air under pressure therefrom;

(b) a second spray nozzle mounted in said second stage evaporator duct for spraying finely divided water into the air received therein countercurrent to the airflow direction thereof;

(c) means for connecting said second spray nozzle to said conduit second spray nozzle; and (d) extractor means in said second stage evaporator duct downstream of said second spray nozzle for extracting free moisture from the air movable through said second stage evaporator duct.

9. An apparatus as claimed in claim 8 wherein said second stage evaporator duct comprises:

(a) an air inlet duct section defining an air inlet passage; and (b) a main duct section integral with said air inlet duct section and defining an expansion chamber of larger cross section than the air inlet passage of said air inlet duct section for reducing the velocity of the air entering therein from said air inlet duct section.

10. An apparatus for evaporatively cooling air comprising:

(a) an evaporator duct;

(b) means coupled to said evaporator duct for supplying air under pressure thereto;

(c) a spray nozzle in said evaporator duct for supplying finely divided water into the incoming air stream countercurrent to the flow direction thereof;

(d) a water supply conduit for delivering water from a remote source of water under pressure to said spray nozzle;

(e) extractor means in said evaporator duct downstream of said spray nozzle for extracting free moisture from the air moving therethrough;

(f) said evaporator duct including,

I. an air inlet duct section of equal cross sectional area along its length an disposed to define an angularly downwardly sloping air inlet passage, and II. a main duct section integral with said air inlet duct section for receiving the air delivered thereby, said main duct section having a substantially horizontal air movement path therethrough; and (g) said spray nozzle disposed in said evaporator duct to spray the finely divided water angularly and upwardly into the air inlet passage defined by said air inlet duct section.

11. An apparatus as claimed in claim 10 wherein said main duct section of said evaporator duct is of larger cross section than said air inlet duct section and defines an expansion chamber in which the air entering said main duct section from said air inlet duct section is reduced in velocity.

12. An apparatus as claimed in claim 10 wherein said extractor means comprises:

(a) a first plurality of spacedly arranged vertically extending vanes which are angularly disposed to deflect air movement through said evaporator duct toward one side thereof; and (b) a second plurality of spacedly arranged vertically extending vanes mounted immediately downstream of said first plurality of vanes and angularly disposed to deflect air movement through said evaporator duct toward the opposite side thereof.

13. An apparatus as claimed in claim 12 wherein each of the vanes of said first and said second plurality of vanes are of substantially planar configuration having an elongated trailing edge which is curved into the airstream of the air deflected thereby.

14. An apparatus as claimed in claim 10 and further comprising means for precooling of the water suppliable by said water conduit.

15. An apparatus as claimed in claim 10 and further comprising:

(a) a water collection sump formed in said evaporator duct for receiving the free moisture from the air movable through said evaporator duct;

(b) overflow means in said sump for disposing of water in excess of a predetermined amount; and (c) said water supply conduit passing through said sump below the surface of the water receivable therein for precooling of the water deliverably by said water supply conduit to said spray nozzle.

16. An apparatus as claimed in claim 15 and further comprising:

(a) a second stage evaporator duct tandemly connected to said evaporator duct for receiving air under pressure therefrom;

(b) a second spray nozzle mounted in said second stage evaporator duct for spraying finely divided water into the air received therein countercurrent to the airflow direction thereof;

(c) means for connecting said second spray nozzle to said conduit second spray nozzle; and (d) extractor means in said second stage evaporator duct downstream of said second spray nozzle for extracting free moisture from the air movable through said second stage evaporator duct.

17. An apparatus as claimed in claim 10 and further comprising:

(a) a second stage evaporator duct tandemly connected to said evaporator duct for receiving the air under pressure therefrom;

(b) a second spray nozzle mounted in said second stage evaporator duct for spraying finely divided water into the air received therein countercurrent to the air flow direction thereof;

(c) means for supplying water from a remote sourcce of water under pressure to said second spray nozzle; and (d) extractor means in said second stage evaporator duct downstream of said second spray nozzle for extracting free moisture from the air movable through said second stage evaporator duct.

* * * * *